US011673715B1

(12) United States Patent
Shimizu et al.

(10) Patent No.: US 11,673,715 B1
(45) **Date of Patent: *Jun. 13, 2023**

(54) CARD OBJECT CARRIER

(71) Applicant: Wells Fargo Bank, N.A., San Francisco, CA (US)

(72) Inventors: Rikuno Shimizu, Walnut Creek, CA (US); Ifeoma M. Metu, Brentwood, CA (US)

(73) Assignee: Wells Fargo Bank, N.A., San Francisco, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/661,667

(22) Filed: May 2, 2022

Related U.S. Application Data

(63) Continuation of application No. 17/161,807, filed on Jan. 29, 2021, now Pat. No. 11,345,515, which is a continuation of application No. 16/026,844, filed on Jul. 3, 2018, now Pat. No. 10,947,013.

(51) Int. Cl.
*B65D 27/04* (2006.01)
*B42D 5/02* (2006.01)
*B65D 27/14* (2006.01)

(52) U.S. Cl.
CPC ..... *B65D 27/04* (2013.01); *B42D 5/025* (2013.01); *B65D 27/14* (2013.01)

(58) Field of Classification Search
CPC ..... B65D 27/04; B65D 27/14; B65D 5/025; B42D 15/04–045
USPC ..... 229/71, 92.1–92.3, 303, 72; 40/124.06
See application file for complete search history.

(56) References Cited

U.S. PATENT DOCUMENTS

| | | | | | |
|---|---|---|---|---|---|
| 1,043,243 | A | | 4/1909 | Mitchell | |
| 1,895,486 | A | | 1/1933 | Overly | |
| 2,078,873 | A | | 8/1936 | Binger | |
| 2,559,776 | A | * | 7/1951 | Larzelere | B42D 15/08 229/92.1 |
| 2,860,826 | A | | 5/1957 | Cooke | |
| RE25,872 | E | * | 10/1965 | O'Gorman | B42D 15/08 229/92.3 |
| 3,508,702 | A | * | 4/1970 | Kaiser | B65D 27/04 229/92.8 |

(Continued)

OTHER PUBLICATIONS

UBS mailer, admitted prior art as of the earliest effect filing date of the present patent application, 1 page.

(Continued)

*Primary Examiner* — Nathan J Newhouse
*Assistant Examiner* — Phillip D Schmidt
(74) *Attorney, Agent, or Firm* — Merchant & Gould P.C.

(57) ABSTRACT

A card carrier includes a presentation substrate, a pocket layer connected to an interior side of the presentation substrate, and a notification carrier configured to fit within a receiving pocket. The presentation substrate defines a presentation address window. The receiving pocket is defined by the pocket layer and the presentation substrate. The pocket layer defines an interior display window configured for displaying card object data and is connected to the presentation substrate such that the interior display window is positioned in a top half of the presentation substrate. When the notification carrier is positioned within the receiving pocket, an address on the notification carrier is visible through the presentation address window.

20 Claims, 13 Drawing Sheets

(56) References Cited

U.S. PATENT DOCUMENTS

| | | | | | |
|---|---|---|---|---|---|
| 3,773,251 | A | | 11/1973 | Hadick | |
| 3,869,964 | A | * | 3/1975 | Kranz | B31D 1/0087 493/333 |
| 3,912,160 | A | * | 10/1975 | Gendron | B65D 27/06 229/303 |
| 3,965,644 | A | * | 6/1976 | Stocker | B43M 3/045 53/284.3 |
| 3,999,700 | A | * | 12/1976 | Chalmers | B65D 27/04 D19/3 |
| 4,585,160 | A | * | 4/1986 | Fiske, II | B42D 15/08 283/58 |
| 5,233,812 | A | * | 8/1993 | Coppola | B43M 5/042 493/216 |
| 5,467,917 | A | * | 11/1995 | Potter | B65D 27/06 229/92.1 |
| 5,678,754 | A | | 10/1997 | Kranz | |
| 6,179,202 | B1 | * | 1/2001 | Alexander | B42D 15/0053 229/92.8 |
| D512,094 | S | | 11/2005 | Mandeel | |
| D517,601 | S | | 3/2006 | Vanderpool | |
| 7,438,213 | B2 | * | 10/2008 | Ackley | G07C 13/00 229/300 |
| D784,446 | S | | 4/2017 | Myricks | |
| D788,845 | S | | 6/2017 | Liguori | |
| 9,878,825 | B1 | | 10/2018 | Ward | |
| D858,632 | S | | 9/2019 | Penn | |
| 10,947,013 | B1 | * | 3/2021 | Shimizu | B65D 27/04 |
| 11,345,515 | B1 | * | 5/2022 | Shimizu | B42F 7/025 |
| 2004/0069661 | A1 | | 4/2004 | Telleen | |
| 2007/0007326 | A1 | | 1/2007 | Miranda | |
| 2011/0186619 | A1 | | 8/2011 | Moresi | |
| 2011/0204132 | A1 | | 8/2011 | Vera | |

OTHER PUBLICATIONS

UBS mailer, admitted prior art as of the the earliest effect filing date of the present patent application, 1 page.

Wells Fargo mailer, admitted prior art as of the earliest effect filing date of the present patent application, 1 page.

* cited by examiner

260

WELLS FARGO

You'll go far with the Wells Fargo Business Elite Card®

Dear Wells Fargo business client,

We're pleased to welcome you as a Wells Fargo Business Elite Card holder. You have real spending power, elite benefits, plus a choice of rewards points or cash back to add value to every purchase.

For your business: You can customize your card with an exceptional rewards program for a low annual fee. Visit wellsfargorewards.com to select unlimited 1.5% cash back or unlimited points you can use to redeem great rewards - whichever best fits your business.

For your convenience, your card is accepted around the globe and there are no foreign transaction fees. You can enjoy the ease of mobile banking on the go. And our Business Elite Servicing Team is always ready to support you with seamless, single touch customer service.

For your protection, you have the latest Chip Technology with Zero Liability should fraudulent charges occur. Plus you have Travel Accident Insurance to safeguard your business travel.

For your information, you can track your account online and receive alerts so you always know where you stand. Business Elite Online Reporting gives you access to reports to help you manage spending and spot savings opportunities.

Plus enjoy these optional features: Get employee cards at no charge and use Spending Controls to set limits. And save time with Automatic Payments linked to your checking account.

Details are enclosed, and you can call 1-800-803-9783 to activate your card.
Thanks for joining us.

Sincerely,

*Signature*
Name
Title

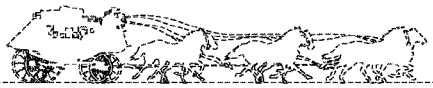

FIG. 12

CARD OBJECT CARRIER

INTRODUCTION

Card objects, such as credit cards, debit cards, membership cards, and the like, are provided to applicants and/or account holders in various ways. In some instances, card objects are mailed to the recipients. These mailings can include sensitive financial data about the intended recipient. The card objects are typically secured to papers in the mailing with a sticky substance.

SUMMARY

Embodiments of the disclosure are directed to providing a card object to a card recipient. Generally, systems and methods disclosed herein relate to providing card object carriers. Typically, a card recipient address is printed on a single component of the card object carrier and that card recipient address is viewable through multiple windows of the card object carrier.

In one aspect, a card carrier is provided. The card carrier includes a presentation substrate, a pocket layer connected to an interior side of the presentation substrate, and a notification carrier configured to fit within a receiving pocket. The presentation substrate defines a presentation address window. The receiving pocket is defined by the pocket layer and the presentation substrate. The pocket layer defines an interior display window configured for displaying card object data and is connected to the presentation substrate such that the interior display window is positioned in a top half of the presentation substrate. When the notification carrier is positioned within the receiving pocket, an address on the notification carrier is visible through the presentation address window.

In another aspect, a method for assembling a card carrier is disclosed. The method includes providing an outer carrier, the outer carrier defining an outer carrier address window; providing a presentation substrate, the presentation substrate defining a presentation address window, the presentation substrate including a receiving pocket, and the receiving pocket defining an interior display window; providing a notification carrier, the notification carrier including a mailing address and a card object; inserting the notification carrier into the receiving pocket such that the mailing address is viewable through the presentation address window and such that the card object is viewable through the interior display window; folding the presentation substrate to generate a folded presentation substrate; and inserting the folded presentation substrate into the outer carrier such that the mailing address is viewable through the outer carrier address window.

In another aspect, a card carrier system is disclosed. The card carrier system includes an outer carrier defining an outer carrier address window, a presentation substrate, a pocket layer connected to an interior side of the presentation substrate, thereby defining a receiving pocket bounded by the pocket layer and the presentation substrate, and a notification carrier. The presentation substrate defines a presentation address window, where the presentation address window aligns with the outer carrier address window when the presentation substrate is positioned in the outer carrier. The pocket layer defines an interior display window. The pocket layer also is connected to the presentation substrate such that the interior display window is positioned in a top half of the presentation substrate. The notification carrier is configured to fit within the receiving pocket and includes an address and a card object removably secured thereto. When the notification carrier is positioned within the receiving pocket, the address on the notification carrier is visible through the outer carrier address window and at least a portion of the card object is viewable through the interior display window. Additionally, the address is visible through the presentation address window from an exterior side of the presentation substrate.

DESCRIPTION OF THE FIGURES

The following drawing figures, which form a part of this application, are illustrative of described technology and are not meant to limit the scope of the disclosure in any manner.

FIG. 12 is a front plan view of an unfolded insert.

DETAILED DESCRIPTION

Figure 1:
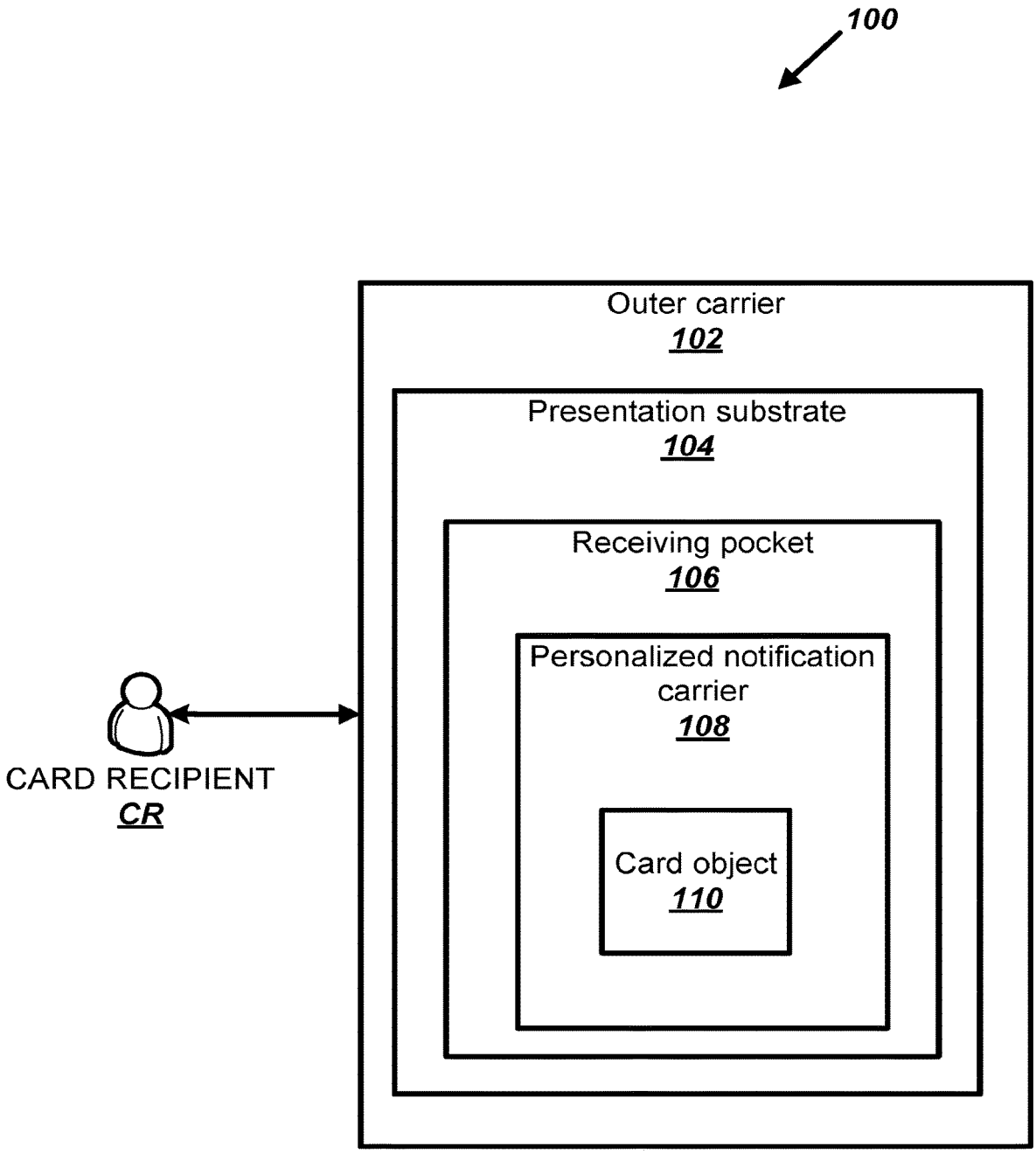
FIG. 1 is a schematic diagram of example personalized card carrier system.

Various embodiments of the present disclosure will be described in detail with reference to the drawings, wherein like reference numerals represent like parts and assemblies throughout the several views. Additionally, any examples set forth in this specification are not intended to be limiting and merely set forth some of the many possible embodiments.

FIG. 1 shows a schematic diagram of example personalized card carrier system 100. Example system 100 includes outer carrier 102, presentation substrate 104, receiving pocket 106, personalized notification carrier 108, and card object 110, such as a credit card, debit card, membership card, or the like. Card recipient CR interacts with various components in system 100 to receive card object 110. Typically, card recipient CR is a customer of an institution and has requested card object 110. Other embodiments can include more or fewer components.

Outer carrier 102 houses various components, such as presentation substrate 104, receiving pocket 106, and/or personalized notification carrier 108. In some instances, outer carrier 102 is an envelope. Outer carrier 102 can be sized variously, typically having a height between 4 inches and 5 inches and a width between 9 inches and 10 inches, inclusive. For example, outer carrier 102 has a height of 4% inches and a width of 9½ inches. Other sizes are contemplated.

Outer carrier 102 typically includes various identifying logos associated with the card object 110 provided to card recipient CR. Usually, outer carrier 102 includes an outer carrier address window. The outer carrier address window is typically translucent such that an address associated with card recipient CR can be viewable therethrough.

Presentation substrate 104 displays information regarding the card object 110 and an address associated with card recipient CR is visible therethrough. Typically, presentation substrate 104 is folded to fit within outer carrier 102. In some instances, presentation substrate 104 is folded along multiple lines before it is placed inside outer carrier 102.

Presentation substrate 104 also defines the presentation address window. When presentation substrate 104 is positioned within outer carrier 102, the presentation address window aligns with the outer carrier address window, such that the address associated with card recipient CR is visible through both the presentation address window and the outer carrier address window.

Presentation substrate 104 is typically designed to be folded such that there is an interior side of the presentation substrate 104 and an exterior side of the presentation substrate 104. The interior side of the presentation substrate 104 defines or is part of receiving pocket 106. Presentation substrate 104 can also define one or more other pockets that can be used to provide information related to the card object 110, such as disclosure and benefit guides.

Receiving pocket 106 is connected to the interior side of the presentation substrate 104. Receiving pocket 106 can be integral to presentation substrate 104 in some embodiments. Receiving pocket 106 defines an interior display window configured for displaying card object 110 data. Typically, receiving pocket 106 is positioned on the interior side of presentation substrate 104 such that the interior display window is positioned in a top half of the presentation substrate 104.

The interior display window defined by receiving pocket 106 is sized and configured to display card object 110 data. For instance, if a card object 110 includes a card number and an account owner name on one side, the card number and the account owner name can be viewable through the interior display window.

Receiving pocket 106 can be configured such that one or both of the outer side edges are not connected to presentation substrate 104. In other embodiments, one of the side edges of receiving pocket 106 is connected to presentation substrate 104. Receiving pocket 106 provides space for personalized notification carrier 108 to be positioned therein.

Personalized notification carrier 108 includes data specific to card recipient CR. Example data specific to card recipient CR include account number, credit limit, address, expiration date, etc. Personalized notification carrier 108 also includes card object 110 removably secured thereto.

When personalized notification carrier 108 is positioned within receiving pocket 106, address data on personalized notification carrier 108 is visible through the presentation address window of presentation substrate 104 and the outer carrier address window defined by outer carrier 102. At the same time, and typically on the opposite side, card object 110 affixed to personalized notification carrier 108 is in part, or in whole, viewable through the interior display window defined by receiving pocket 106. In some instances, personalized notification carrier 108 is folded along at least two lines to fit within receiving pocket 106.

Through the use of a single address printed on personalized notification carrier 108, personalized card carrier system 100 beneficially improves workflows and accuracy surrounding providing card objects to card recipients. For instance, quality checks on a credit card mailing are simplified using personalized card carrier system 100. Because the card object, which has cardholder name and other data, is affixed to personalized notification carrier 108, a reviewer need only verify that the card object matches the address information on the personalized notification carrier 108. Because address data on personalized notification carrier 108 appear through a window in outer carrier 102, there are no separate addresses affixed to the outer carrier 102 that can introduce possible errors, such as mailing a card object to an unintended recipient, exposing sensitive data about the intended recipient.

Figure 2:
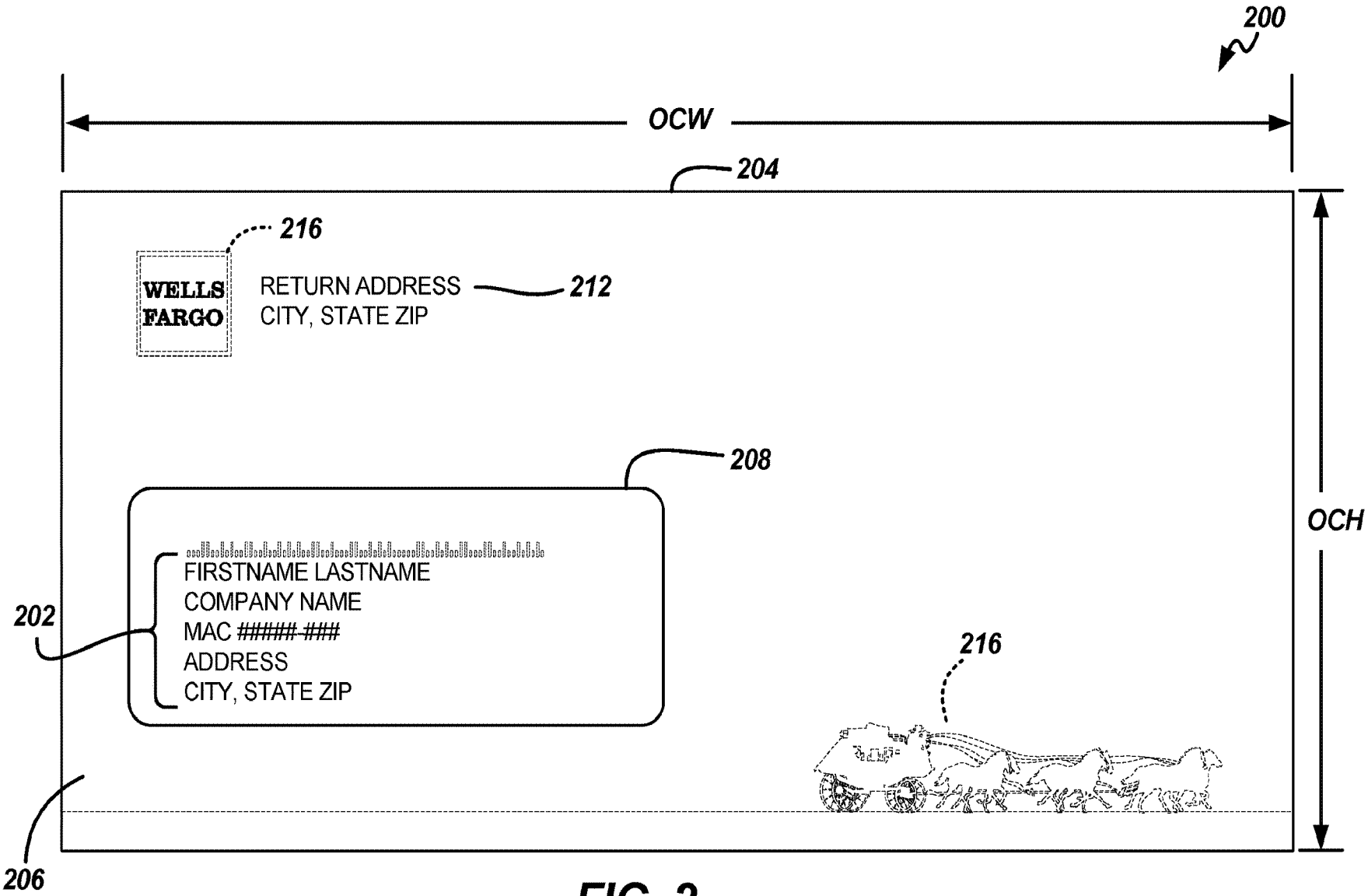
FIG. 2 is a front plan view of an example personalized card carrier system.
Figure 3:
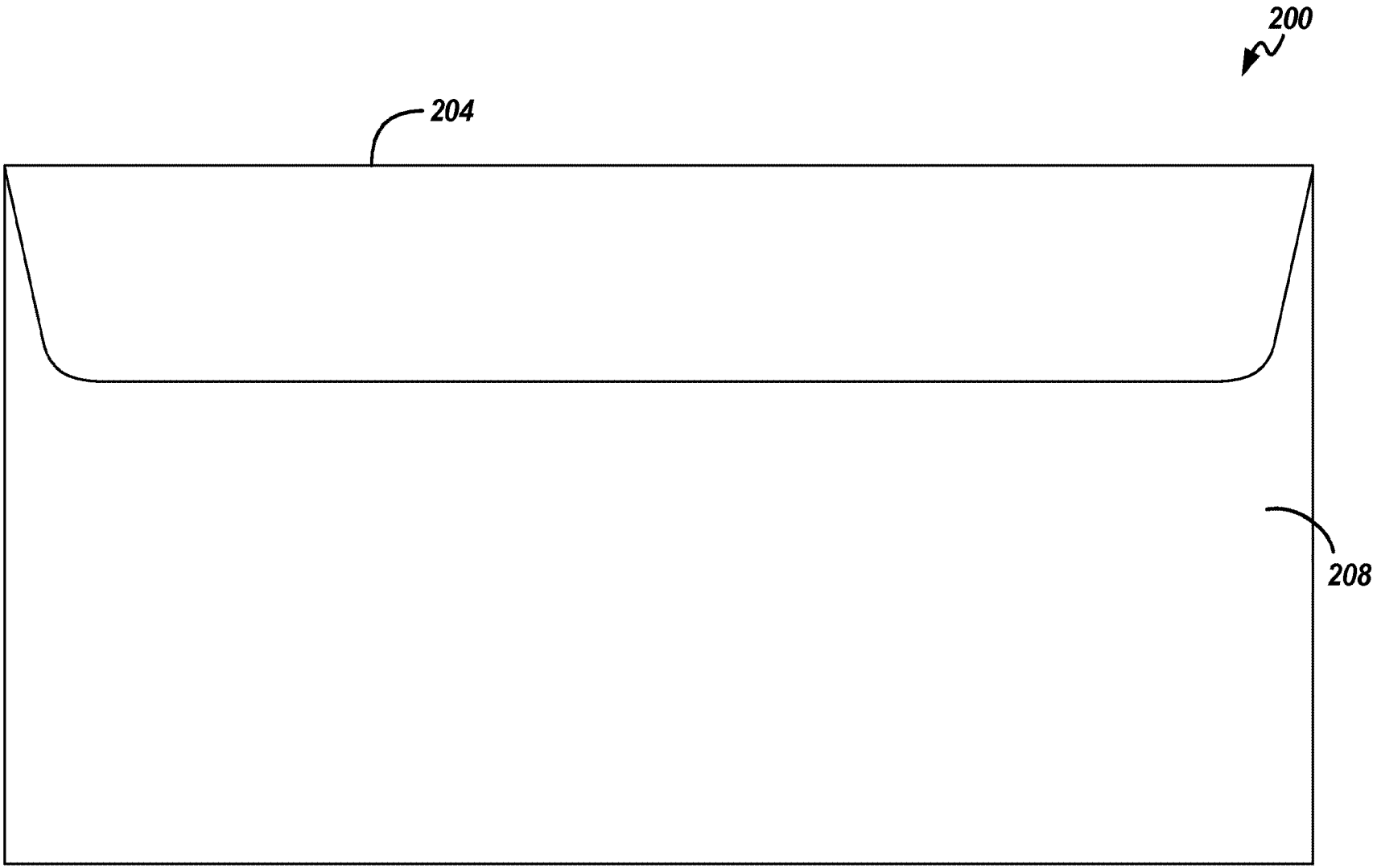
FIG. 3 is a rear plan view of the personalized card carrier system of FIG. 2.

FIGS. 2 and 3 are front and rear plan views, respectively, of an example personalized card carrier system 200. FIGS. 4-12 show example components that can be positioned within personalized card carrier system 200. Example personalized card carrier system 200 includes some or all components of example system 100 described above with reference to FIG. 1. FIGS. 2 and 3 show outer carrier 204, which houses presentation substrate 218, personalized notification carrier 244, card object 246, and other components.

As shown in FIG. 2, outer carrier 204 has an outer carrier front side 206 that defines outer carrier address window 208. Card recipient address 202 is visible through outer carrier address window 208. As discussed above, card recipient address 202 is provided on personalized notification carrier 244.

Outer carrier 204 also includes return address 212 and institution logo 214 and institution logo 216. Return address 212 and institution logos 214 and 216, it will be appreciated, can be modified or amended in various implementations.

Outer carrier 204 is typically implemented as an envelope, such as a rectangular envelope. Outer carrier 204 has an outer carrier width OCW and an outer carrier height OCH. Usually, outer carrier width OCW is at least 8 inches and no more than 10 inches. In some instances, outer carrier width OCW is no less than 8.5 inches and no greater than 9.5 inches. In one implementation, outer carrier width OCW is 8.75 inches. Outer carrier height OCH is typically at least 4 inches and no greater than 5 inches. In some implementations, outer carrier height OCH is at least 4.25 inches but no greater than 4.75 inches. In one implementation, outer carrier height OCH is 4.25 inches.

Figure 4:
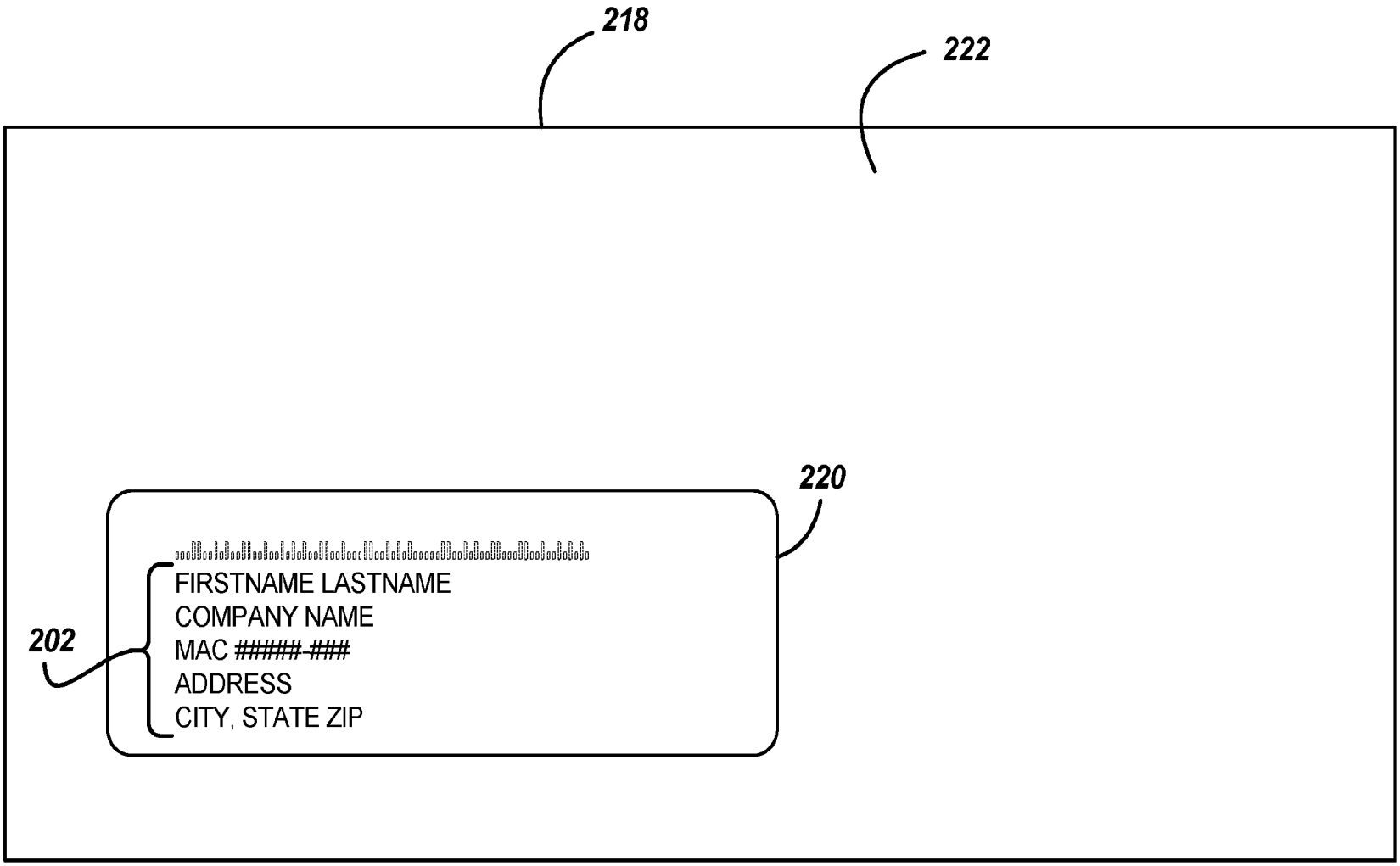
FIG. 4 is a front plan view of an example presentation substrate used in the personalized card carrier system of FIG. 2.
Figure 5:
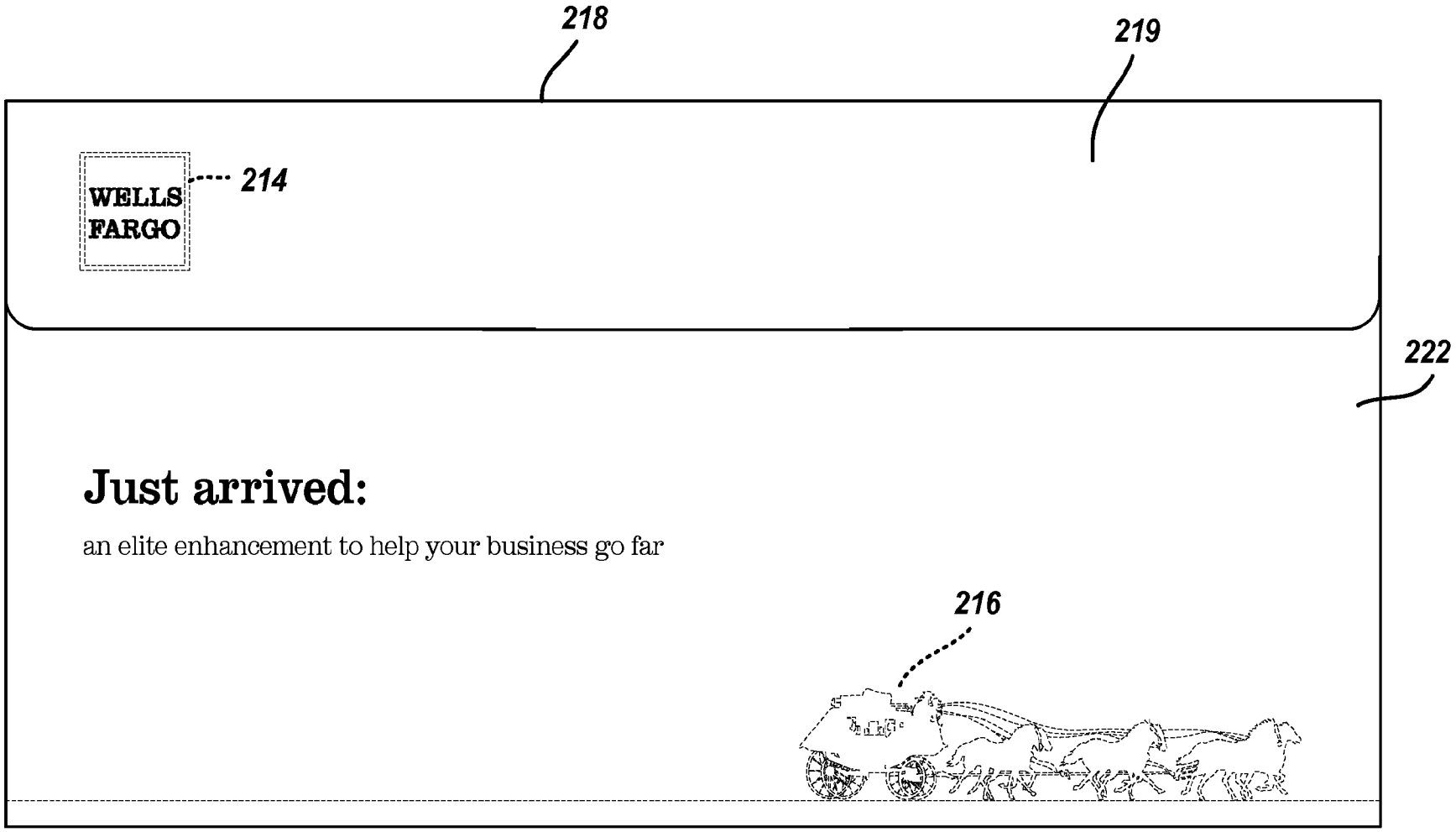
FIG. 5 is a rear plan view of the example presentation substrate of FIG. 4.

Referring now to FIGS. 4 and 5, an example embodiment of presentation substrate 218 is provided. FIG. 4 is a front plan view of a folded presentation substrate 218. FIG. 5 is a rear plan view of the folded presentation substrate 218 shown in FIG. 4. As shown, presentation substrate 218 includes personalized notification carrier 244 positioned therein.

When folded, presentation substrate 218 has presentation substrate exterior side 222. On the front of presentation substrate exterior side 222, presentation substrate 218 defines presentation address window 220. In presentation address window 220, card recipient address 202 is visible. As noted above, card recipient address 202 is printed on personalized notification carrier 244.

Referring to FIG. 5, presentation substrate 218 has presentation substrate flap 219 which results from multiple folds of presentation substrate 218. Optionally, presentation substrate flap 219 includes institution logo 214. Presentation substrate exterior side 222 can also include institution logo 216.

Figure 6:
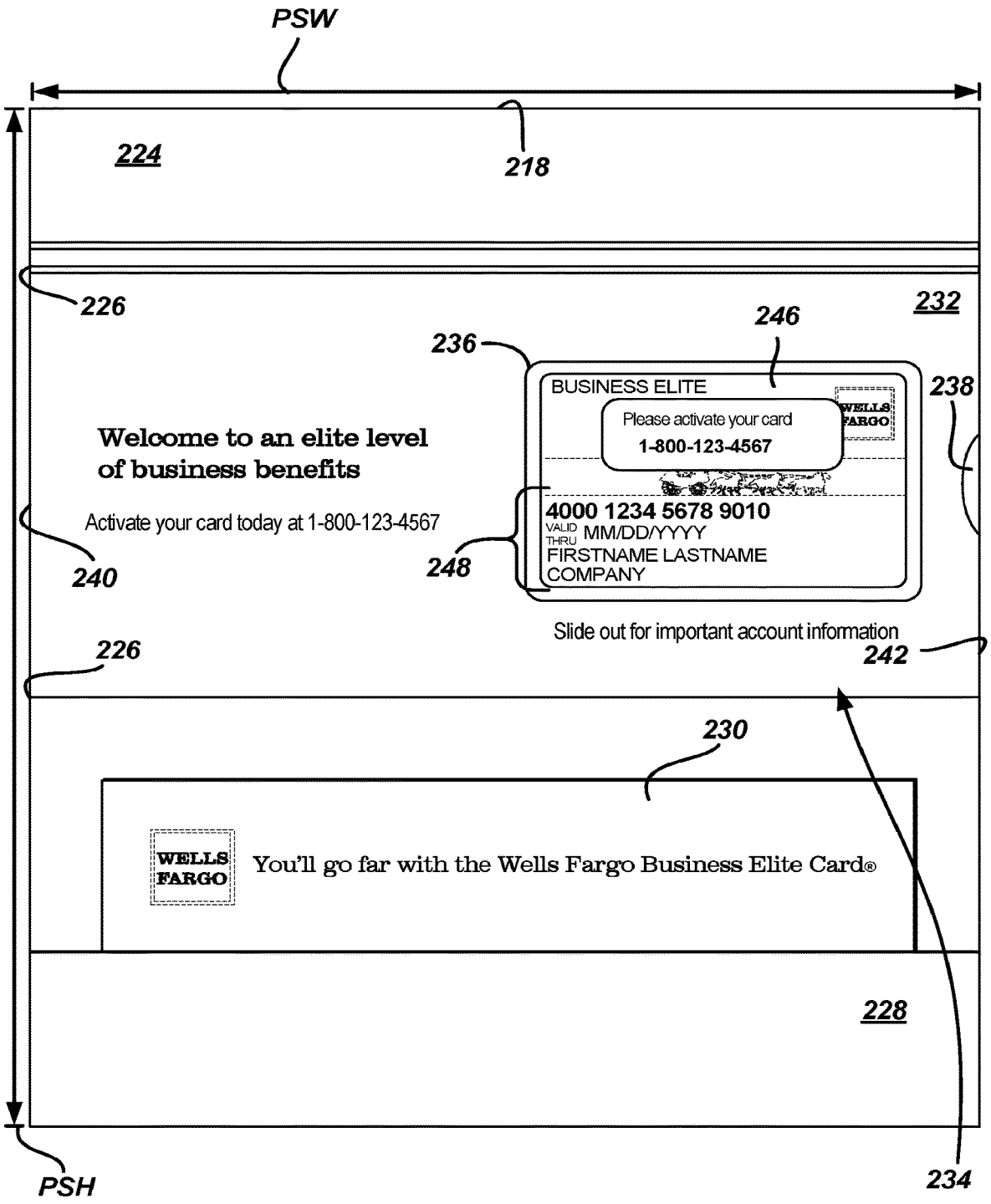
FIG. 6 is a front plan view of an unfolded status of the presentation substrate of FIG. 4.

Referring now to FIG. 6, unfolded presentation substrate 218 is shown. The side visible in FIG. 6 is presentation substrate interior side 224. Presentation substrate interior side 224 is visible upon unfolding the folded version of presentation substrate 218 shown in FIGS. 4 and 5.

Presentation substrate interior side 224 is folded along fold line 226 so that presentation substrate 218 can fit within outer carrier 204. In the embodiment shown, two fold lines 226 are used. However, in other implementations, more or fewer fold lines 226 can be used.

Presentation substrate interior side 224 also includes pocket 228, optionally included, positioned near a bottom portion of presentation substrate 218. Pocket 228 can be included to house various inserts 230. Example inserts 230 include benefits, terms, and other informational packets related to the card object provided to the card recipient. See, for example, FIG. 12.

Presentation substrate 218 also defines receiving pocket 234 on presentation substrate interior side 224. In some implementations, receiving pocket 234 is created between pocket layer 232 and presentation substrate interior side 224.

In some instances, pocket layer 232 is secured to presentation substrate 218 along edge 240. Pocket layer 232 is usually unsecured to presentation substrate 218 along edge 242, thereby enabling insertion and withdrawal of personalized notification carrier 244 through that end. That is, pocket layer 232 can be secured to presentation substrate 218 along two of the four edges or along three of the four edges. In some instances, pocket layer 232 defines thumb grip cutout 238. Thumb grip cutout 238 facilitates insertion and withdrawal of personalized notification carrier 244.

Pocket layer 232 defines interior display window 236. As discussed above, interior display window 236 enables viewing of card object 246. Typically, card object 246 is removable through interior display window 236. However, in other implementations, interior display window 236 is sized differently, such that only a portion of card object 246 is visible through interior display window 236. As shown in FIG. 6, card object data 248 is visible through interior display window 236. As shown, pocket layer 232 is connected to the presentation substrate such that the interior display window is positioned in a top half of the presentation substrate.

Presentation substrate 218 has a presentation substrate width PSW and a presentation substrate height PSH. Typically, presentation substrate width PSW is at least 8 inches but no greater than 10 inches. In some instances, presentation substrate width PSW is at least 8.5 inches and no greater than 9.5 inches. In one implementation presentation substrate width PSW is 8.5 inches. Presentation substrate height PSH is typically at least 10 inches but no greater than 12 inches. In one implementation, presentation substrate height PSH is 11 inches.

Figure 7:
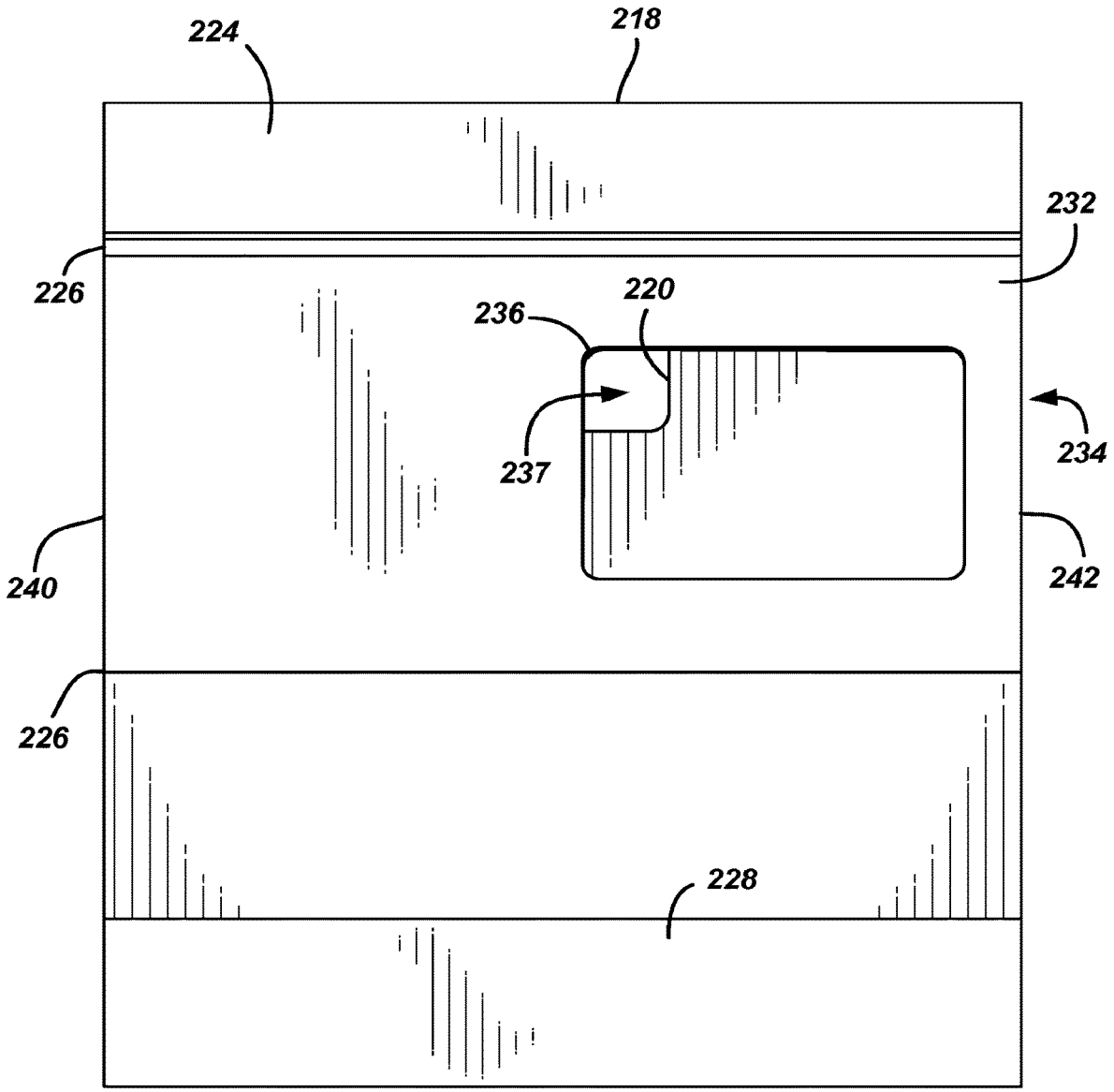
FIG. 7 is a front plan view of an unfolded status of a presentation substrate without a personalized notification carrier positioned therein.
Figure 8:
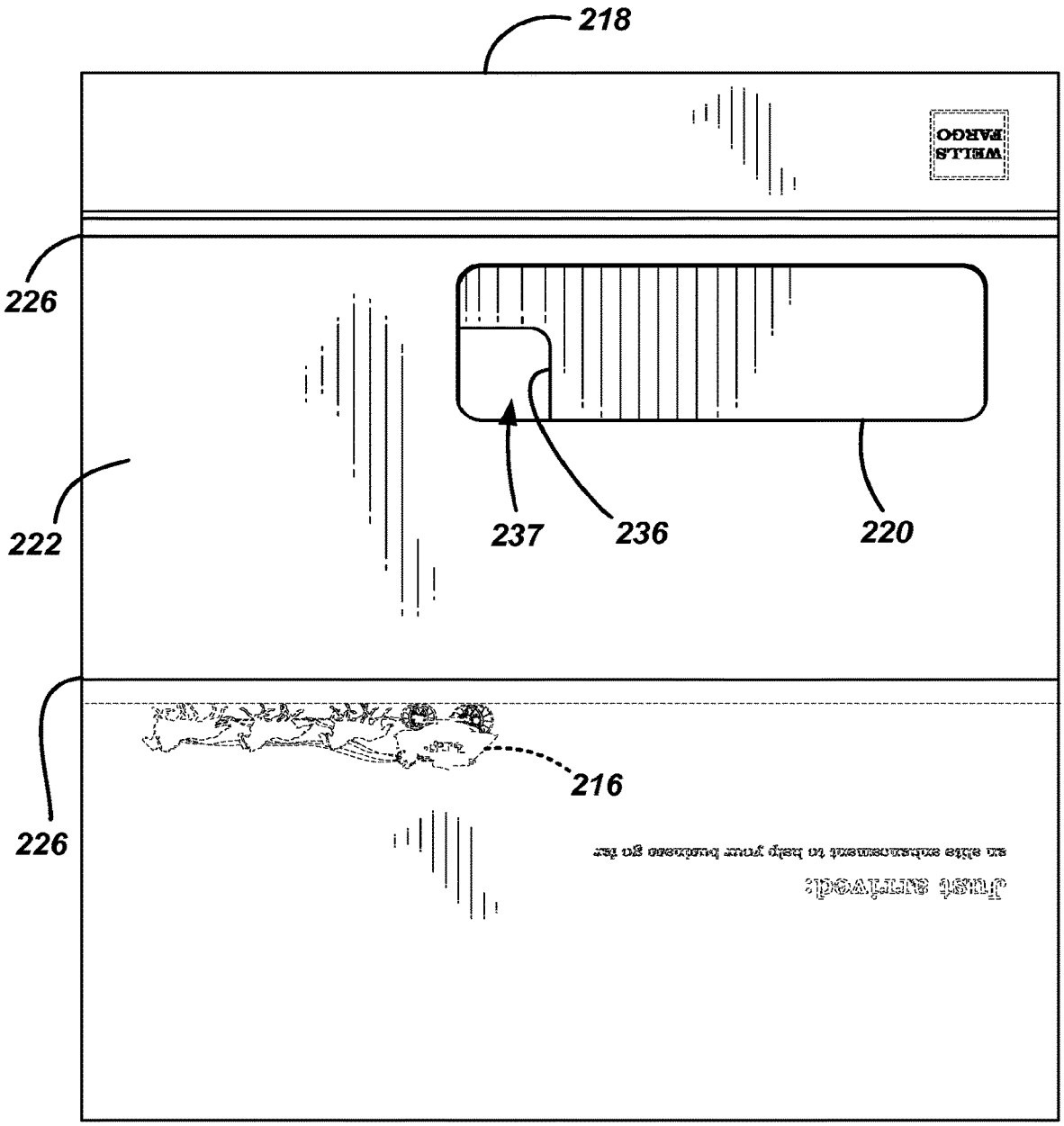
FIG. 8 is a rear plan view of the presentation substrate shown in FIG. 7.

FIG. 7 and FIG. 8 show a front plan view and a rear plan view, respectively, of an unfolded presentation substrate 218. As shown in FIGS. 7 and 8, presentation substrate 218 does not include personalized notification carrier 244 positioned therein. In the configuration shown, there is window overlap area 237 between presentation address window 220 and interior display window 236.

Figure 9:
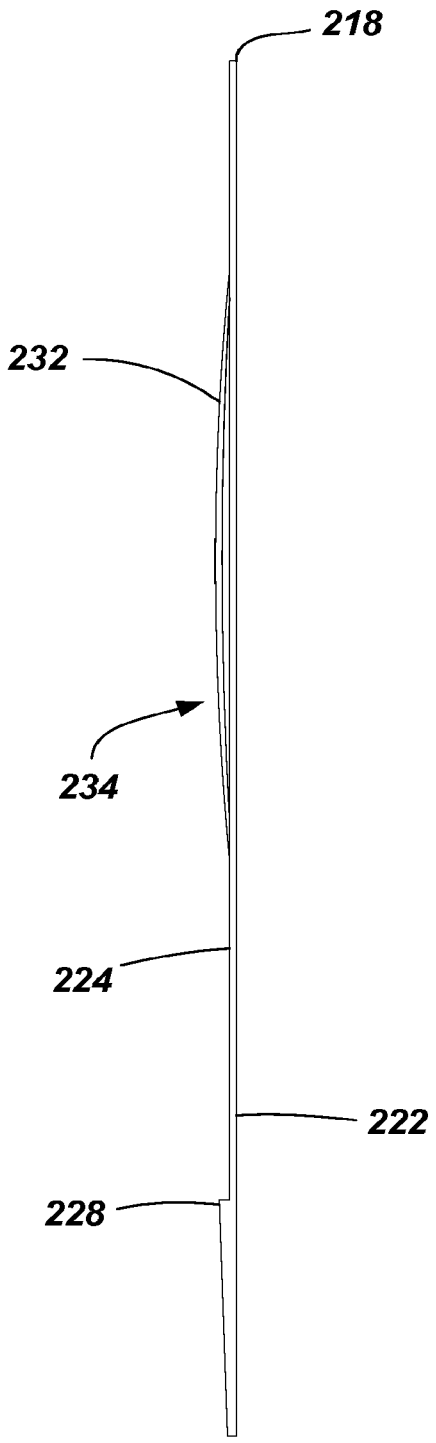
FIG. 9 is a side plan view of an example presentation substrate.

FIG. 9 is a side plan view of an example embodiment of presentation substrate 218. In the embodiment shown, presentation substrate 218 includes receiving pocket 234 formed by pocket layer 232 and presentation substrate interior side 224.

Figure 10:
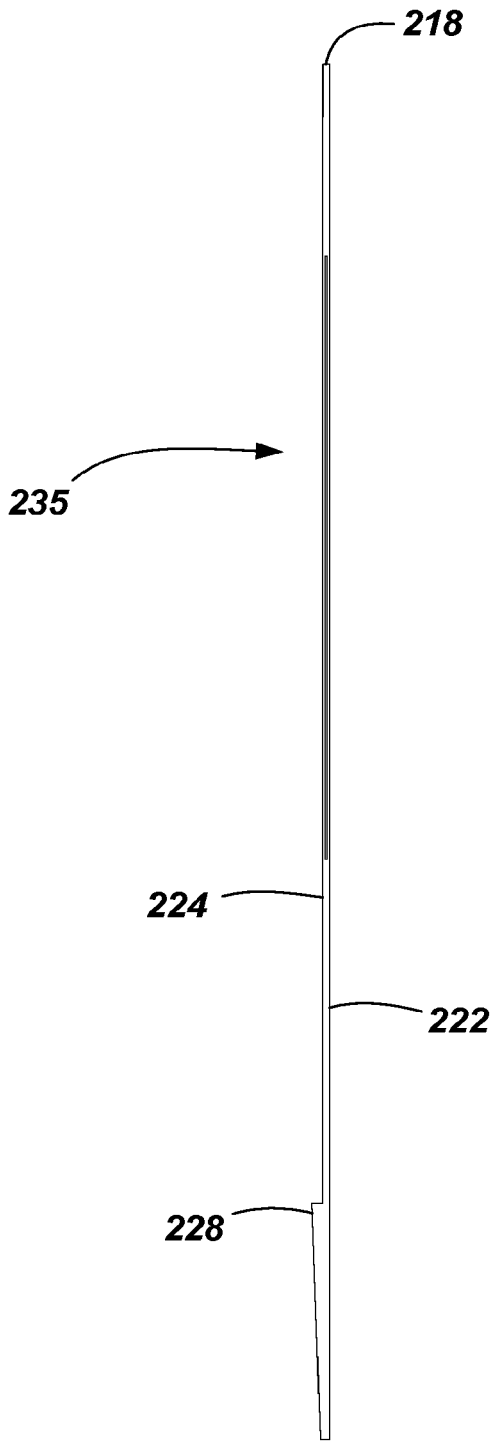
FIG. 10 is a side plan view of another example presentation substrate.

FIG. 10 is a side plan view of an alternate embodiment of presentation substrate 218. The embodiment shown in FIG. 10 includes receiving pocket 235. Receiving pocket 235 is defined between presentation substrate exterior side 222 and presentation substrate interior side 224. For ease of explanation, and not meant to be limiting, receiving pocket 235 can be thought of as a cutout in presentation substrate 218.

Figure 11:
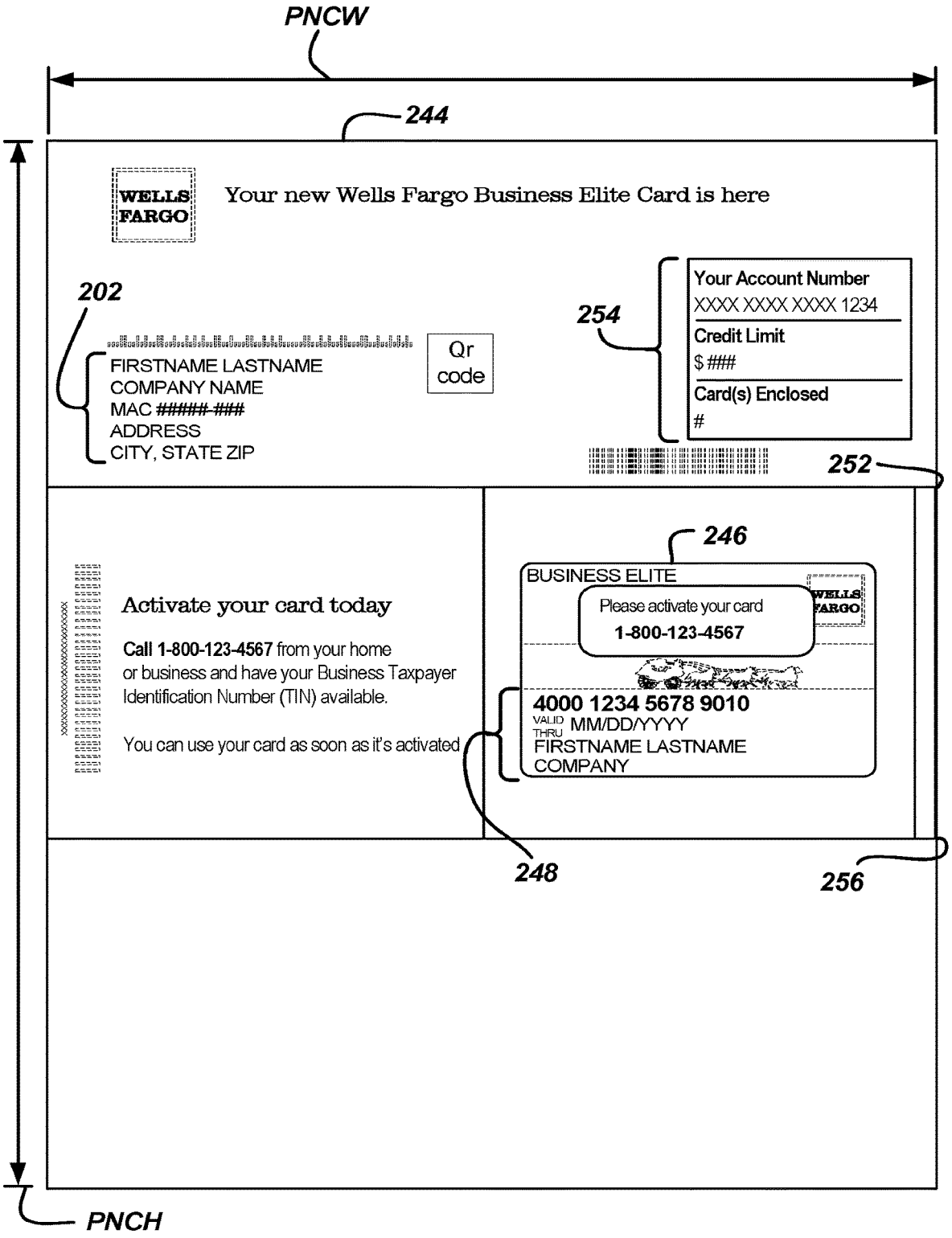
FIG. 11 is a front plan view of an unfolded personalized notification carrier.

FIG. 11 shows a front plan view of an example personalized notification carrier 224. In FIG. 11, personalized notification carrier 244 is unfolded. However, in the embodiment shown, personalized notification carrier 244 is folded along fold line 252 and 256. In other implementations, personalized notification carrier 244 can be sized and configured such that no folding is necessary to position personalized notification carrier 244 within receiving pocket 234, while also simultaneously displaying card object 246 and card recipient address 202.

Personalized notification carrier 244, as noted above, includes card recipient address 202. Personalized notification carrier 244 also includes account data 254. Example account data includes account number, credit limit, and card number. Other account data 254 can be included in personalized notification carrier 244.

Personalized notification carrier 244 includes card object 246 secured thereto. Typically, card object 246 is secured removably such that a card recipient can remove card object 246 relatively easily from personalized notification carrier 244, while at the same time, card object 246 is adhered to personalized notification carrier 244 such that during transport card object 246 does not detach from personalized notification carrier 244. In the embodiment shown, card object 246 is positioned above fold line 256 and below fold line 252. Fold line 252 and fold line 256 divide personalized notification carrier 244 into, roughly, one-third portions. Thus, in the embodiment shown, card object 246 is positioned in the middle third of personalized notification carrier 244.

Personalized notification carrier 244 has personalized notification carrier width PNCW and personalized notification carrier height PNCH. Typically, personalized notification carrier width PNCW is at least 6 inches but no greater than 9 inches. In some instances, personalized notification carrier width PNCW is at least 7 inches but no greater than 8 inches. In one implementation, personalized notification carrier width PNCW is 7.5 inches. Personalized notification carrier height PNCH is typically at least 9 inches, but no greater than 11 inches. In one implementation, personalized notification carrier height PNCH is 10 inches. Other sizes are contemplated.

FIG. 12 shows an example of the insert 230 in an unfolded state. The example insert 230 can include various information, such as benefits, terms, and other informational packets related to the card object provided to the card recipient. As shown in FIG. 6, the insert 230 can be folded and placed in the pocket 228 of the presentation substrate interior side 224 to house the insert 230. Multiple inserts and/or other information can also be placed in the pocket 228.

Figure 13:
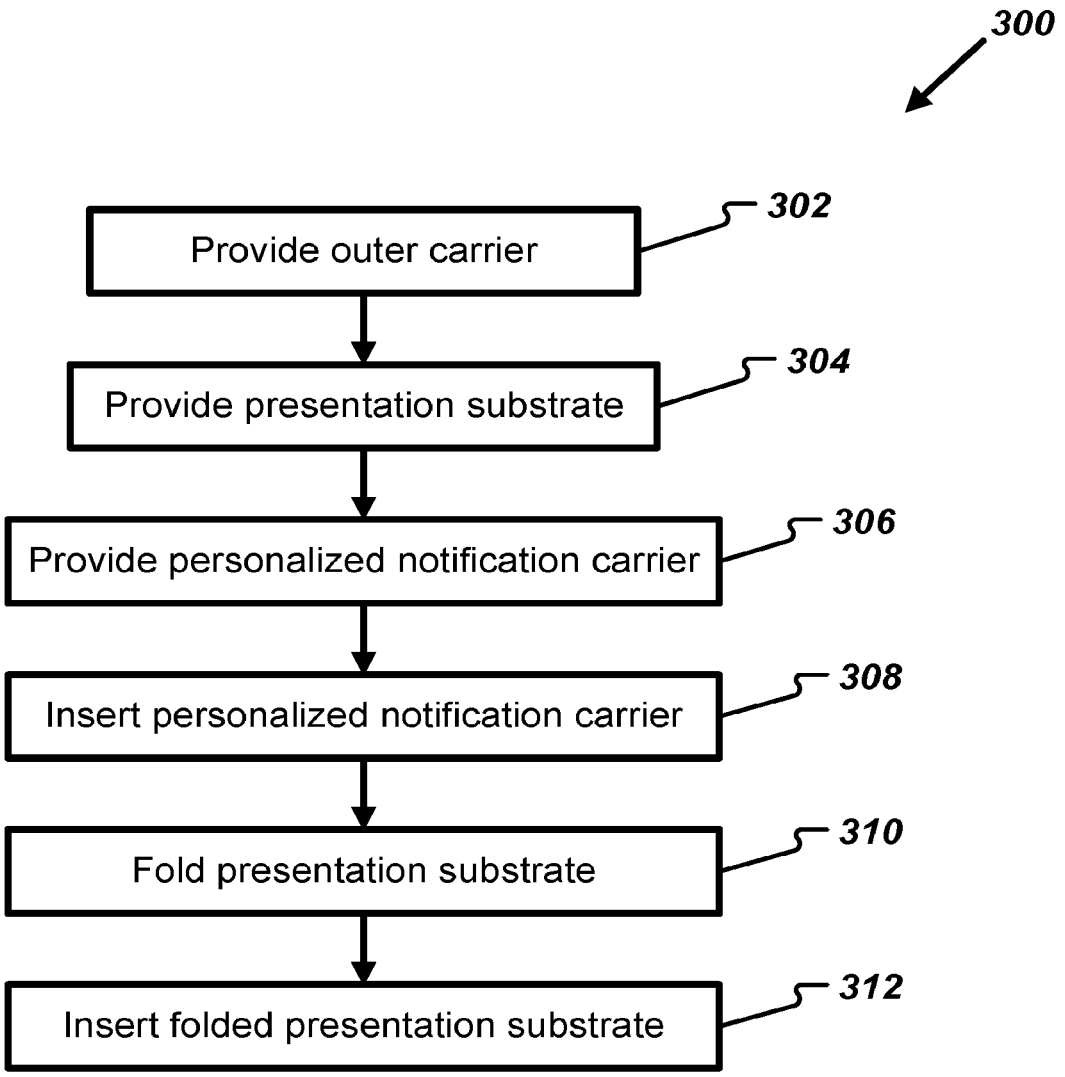
FIG. 13 is an example method for assembling a personalized card carrier.

FIG. 13 shows example method 300 for assembling a personalized card carrier. In some instances, example method 300 can be used to assemble example system 100 and/or example system 200 described above. Other embodiments can include more or fewer operations than those shown in FIG. 13.

Example method 300 begins by providing an outer carrier (operation 302). Example embodiments of an outer carrier are described above, and the outer carrier defines an outer carrier address window. A presentation substrate is also provided (operation 304). The presentation substrate defines a presentation address window and includes a receiving pocket, where the receiving pocket defines an interior display window. The presentation substrate provided in operation 304 can be similar to the presentation substrates described above. A personalized notification carrier is also provided (operation 306). The personalized notification carrier includes a mailing address of a card recipient and a card object.

After providing the outer carrier (operation 302), providing presentation substrate (operation 304), and providing personalized notification carrier (operation 306), the personalized notification carrier is inserted (operation 308). Here, the personalized notification carrier is inserted into the receiving pocket such that the mailing address on the personalized notification carrier is viewable through the presentation address window. Operation 308 also includes ensuring that the card object is viewable through the interior display window. In some instances, operation 308 can include folding the personalized notification carrier prior to inserting the personalized notification carrier into the receiving pocket. In some instances, inserting the personalized notification carrier includes, prior to insertion, folding the personalized notification carrier one or more times. Typically, personalized notification carrier is folded twice.

Next, the presentation substrate is folded (operation 310). In some instances, operation 310 can include inserting an explanatory booklet into a pocket defined by the presentation substrate prior to folding the presentation substrate. During operation 310, the presentation substrate can be folded along at least one line. Typically the presentation substrate is folded along two different lines, and a flap is formed that can be used to create a sealed look. A result of operation 310 is the generation of a folded presentation substrate.

Last, the folded presentation substrate is inserted into the outer carrier (operation 312). Operation 312 includes ensuring that the mailing address is viewable through the outer carrier address window.

What is claimed is:

1. A card carrier, comprising:

a presentation substrate having an interior side, an exterior side, a folded configuration and an unfolded configuration, the presentation substrate in the unfolded configuration extending from a first edge to a second edge along an elongate first dimension of the presentation substrate and between a third edge and a fourth edge of the presentation substrate along a second dimension of the presentation substrate that is perpendicular to, and shorter than, the elongate first dimension, the presentation substrate being configured to be folded at fold lines into the folded configuration and inserted in the folded configuration into an envelope, the presentation substrate defining a presentation address window in an exterior side of the presentation substrate, the presentation address window being fully enclosed by the presentation substrate, the fold lines being positioned between the first edge and the second edge and extending parallel to the second dimension, the presentation substrate defining a pocket in the folded configuration and the unfolded configuration, the pocket being positioned entirely between the fold lines, the pocket defining a fully enclosed interior display window; and a notification carrier positioned within the pocket, the notification carrier including a first side and a second side opposite the first side, wherein when the presentation substrate is in the unfolded configuration, the first side of the notification carrier is displayed through the fully enclosed interior display window and, simultaneously therewith, the second side of the notification carrier is displayed through the presentation address window.

2. The card carrier of claim 1, wherein the fully enclosed interior display window is positioned in a top half of the presentation substrate.

3. The card carrier of claim 1, wherein a center of the presentation address window is offset from a center of the fully enclosed interior display window.

4. The card carrier of claim 1, wherein the presentation address window only partially overlaps the fully enclosed interior display window.

5. The card carrier of claim 1, further comprising a pocket layer secured to the presentation substrate.

6. The card carrier of claim 5, wherein the pocket layer includes four edges, and wherein the pocket layer is secured to the presentation substrate along two of the four edges.

7. The card carrier of claim 6, wherein the pocket layer is secured to the presentation substrate along three of the four edges.

8. The card carrier of claim 1, wherein the pocket is defined between the interior side and the exterior side.

9. The card carrier of claim 1, further comprising another pocket positioned on the interior side of the presentation substrate.

10. The card carrier of claim 9, wherein an edge of the another pocket coincides with the second edge of the presentation substrate.

11. The card carrier of claim 10, wherein an insert is positioned in the another pocket.

12. The card carrier of claim 1, wherein the notification carrier is folded along two notification carrier fold lines.

13. The card carrier of claim 1, wherein the notification carrier is not folded.

14. The card carrier of claim 1, wherein the notification carrier includes a card recipient address.

15. The card carrier of claim 14, further comprising a card object secured to the notification carrier.

16. The card carrier of claim 15, wherein the card object is displayed through the fully enclosed interior display window and, simultaneously therewith, the card recipient address is displayed through the presentation address window.

17. The card carrier of claim 16, further comprising the envelope, wherein the presentation substrate is in the folded configuration and positioned in the envelope.

18. The card carrier of claim 17, wherein the card recipient address is displayed through an envelope window defined by the envelope.

19. The card carrier of claim 1, wherein the fully enclosed interior display window and the presentation address window have different shapes.

20. A card carrier, comprising:

a presentation substrate having an interior side, an exterior side, a folded configuration and an unfolded configuration, the presentation substrate in the unfolded configuration extending from a first edge to a second edge along an elongate first dimension of the presentation substrate and between a third edge and a fourth edge of the presentation substrate along a second dimension of the presentation substrate that is perpendicular to, and shorter than, the elongate first dimension, the presentation substrate being configured to be folded at fold lines into the folded configuration and inserted in the folded configuration into an envelope, the presentation substrate defining a presentation address window in an exterior side of the presentation substrate, the presentation address window being fully enclosed by the presentation substrate, the fold lines being positioned between the first edge and the second edge and extending parallel to the second dimension, the presentation substrate defining a pocket in the folded configuration and the unfolded configuration, the pocket being positioned entirely between the fold lines, the pocket defining a fully enclosed interior display window;

a notification carrier positioned within the pocket, the notification carrier including a first side and a second side opposite the first side;

another pocket positioned on the interior side of the presentation substrate, an edge of the another pocket coinciding with the second edge of the presentation substrate and an insert positioned in the another pocket, wherein when the presentation substrate is in the unfolded configuration, the first side of the notification carrier is displayed through the fully enclosed interior display window and, simultaneously therewith, the second side of the notification carrier is displayed through the presentation address window; and wherein the fully enclosed interior display window and the presentation address window have different shapes.

* * * * *